US005107652A

United States Patent [19]

Sosa

[11] Patent Number: 5,107,652

[45] Date of Patent: Apr. 28, 1992

[54] CONSTRUCTION MODULE

[75] Inventor: Ricardo R. Sosa, Berga, Spain

[73] Assignee: Innovacions Tegnologiques S.A. I.T.S.A., Berga, Spain

[21] Appl. No.: 523,812

[22] Filed: May 16, 1990

[30] Foreign Application Priority Data

May 24, 1989 [ES] Spain ..... 8902203[U]

[51] Int. Cl.[5] ..... A47G 5/00

[52] U.S. Cl. ..... 52/578; 160/135; 52/586; 52/71

[58] Field of Search ..... 52/71, 584, 585, 586, 52/284, 285; 160/135, 351; 305/58 R, 58 PC

[56] References Cited

U.S. PATENT DOCUMENTS

| | | | |
|---|---|---|---|
| 998,086 | 7/1911 | Goehler | 52/285 X |
| 2,521,279 | 9/1950 | Becker | 52/585 X |
| 4,821,788 | 4/1989 | Nelson | 160/351 X |
| 4,823,858 | 4/1989 | Perutz | 160/135 |
| 4,880,210 | 11/1989 | Cucksey | 160/351 X |

*Primary Examiner*—David A. Scherbel
*Assistant Examiner*—Wynn Wood
*Attorney, Agent, or Firm*—Fleit, Jacobson, Cohn, Price, Holman & Stern

[57] ABSTRACT

Improved construction module comprising a reinforced or prestressed concrete slab (10) having a generally prismatic outer shape in which two of the parallel opposite edges thereof are provided with a plurality of mutually aligned protuberances (10') staggered on opposite edges. The surfaces forming the upper and lower edges are provided with channels (13, 13') which allow modules placed one above the other to be coupled by inserts fitted into the channels. The protuberances (10') on opposite parallel surfaces have aligned bores (11) in which rods (11') are insertable to allow several modules to be coupled together side by side and edge to edge.

8 Claims, 2 Drawing Sheets

FIG. 2
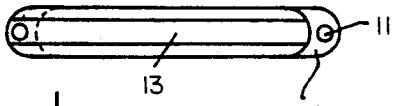
FIG. 1
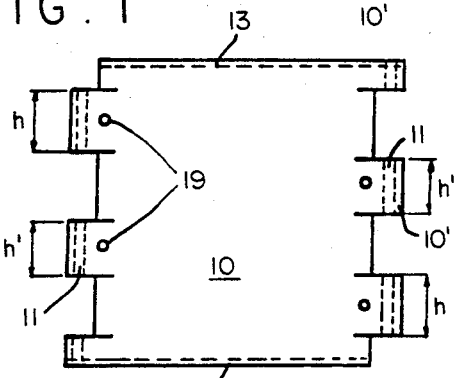
FIG. 3
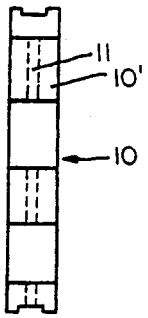
FIG. 5
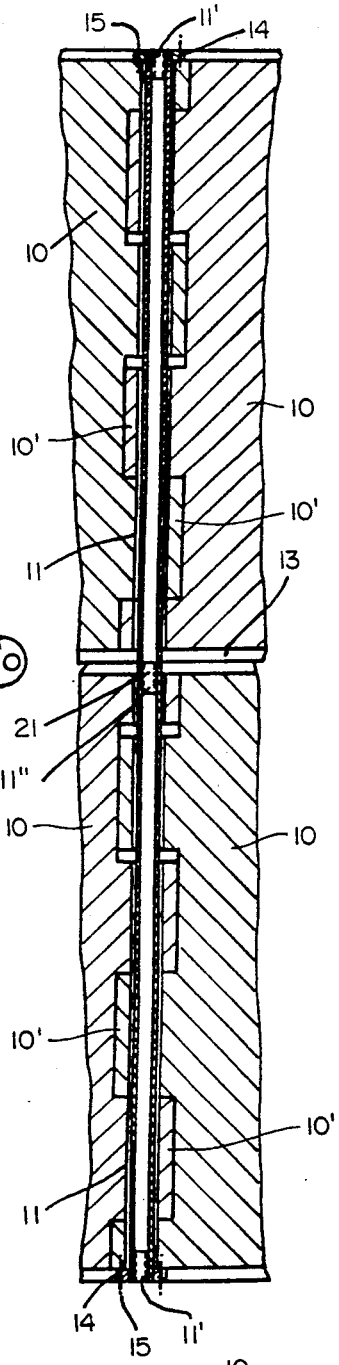
FIG. 4
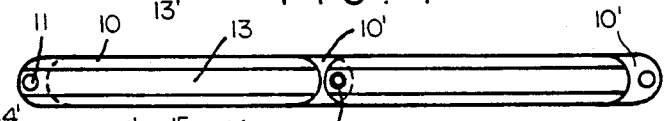
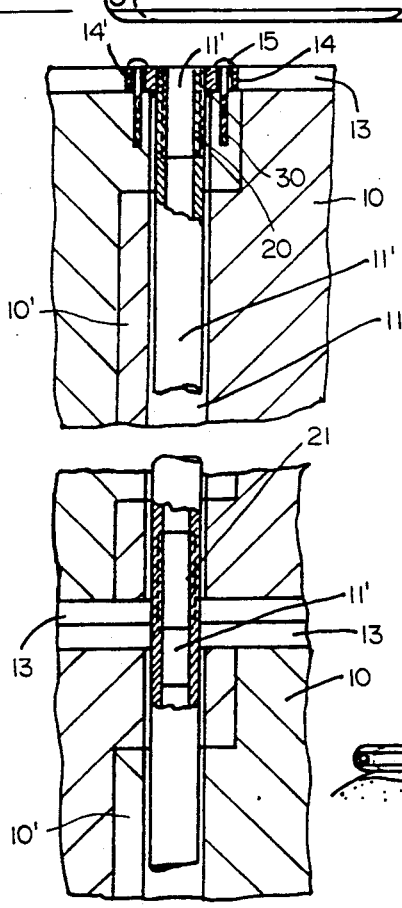
FIG. 6
FIG. 7
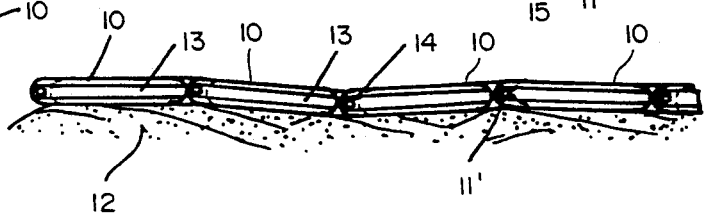

FIG. 8
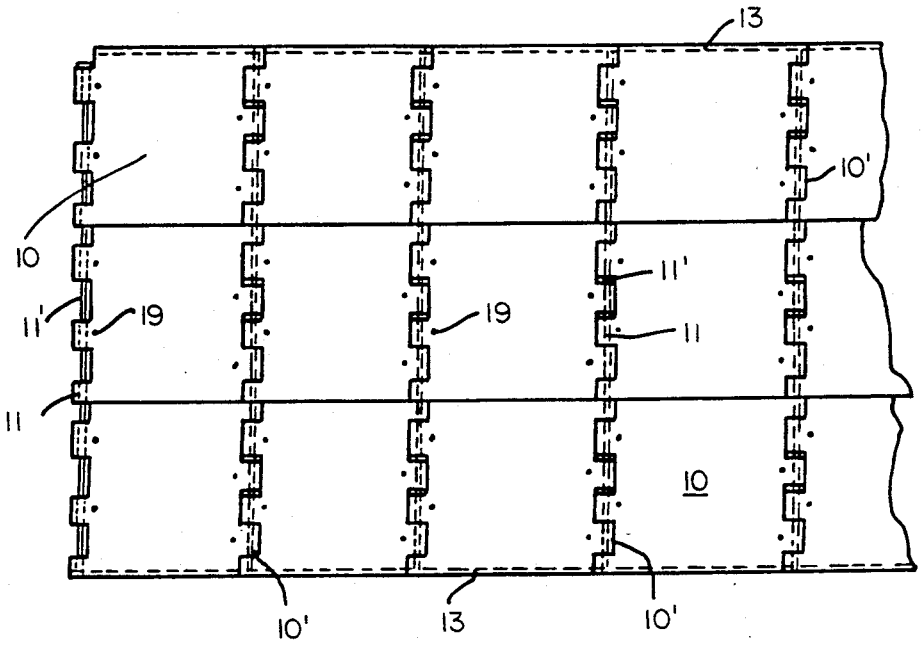
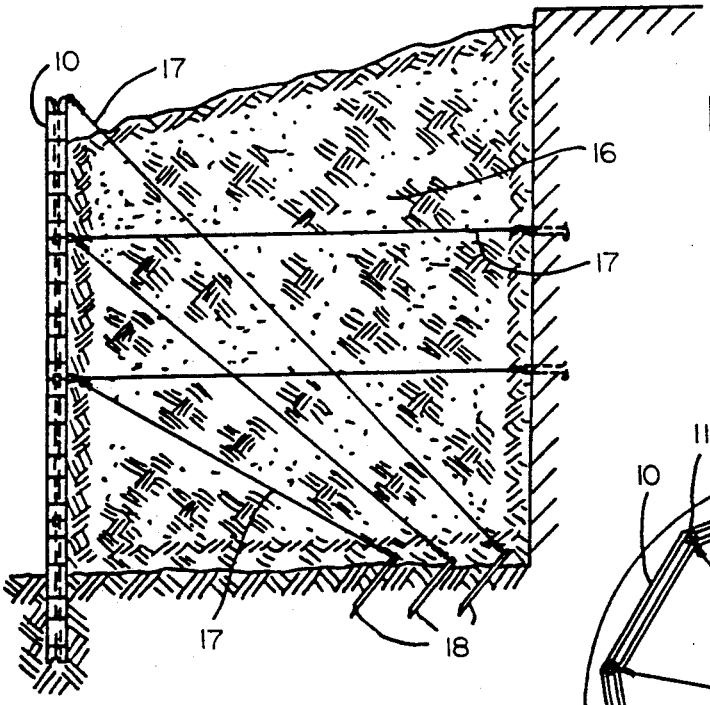
FIG. 9
FIG. 10
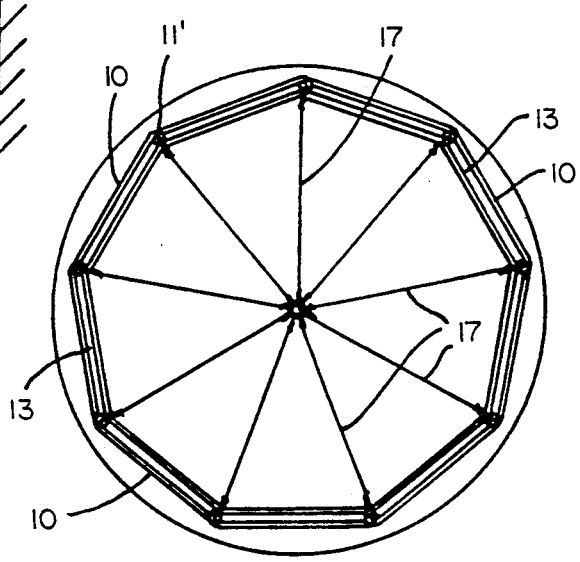

CONSTRUCTION MODULE

The present invention relates to construction modules and more particularly to new construction, shape and design features thereof which fulfill the purpose for which construction modules are specifically devised with maximum reliability and efficiency.

There is on the market and, therefore, may be deemed to be know in the prior art, a set of multipurpose building modules, which are characterized in that by static superimposition and in view of their intrinsic geometric configuration, they allow walls, tanks, embankments and other retaining members to be formed by mutual coupling them together, thereby aiding an assembly of larger works to be duly consolidated.

Nevertheless, the majority of the elements on the market are coupled together rigidly, i.e., the relationship between two or more elements is always rigid and the same relative position is maintained between them, all of which limits the application of the modules by predetermined geometrical layouts, without allowing alteration due to the very shape of the said modules.

BRIEF SUMMARY OF THE INVENTION

The object of the present invention is, among other relevant aspects, to change the static or rigid nature of the coupling together of several modules by making the coupling dynamic, i.e., since the modules will always have the same geometrical form. their coupling together may be adapted to the conditions and geometric form of the works in which they are used.

The improved module of the present application is formed by a slab of reinforced or prestressed concrete, having a generally prismatic shape in which two of the edges are provided with a number of mutually aligned protuberances alternating with those on the mating edge of adjacent modules. The top and bottom edges are each provided with a channel which allows the coupling together of one module with another one placed above and another one placed below by insertion of a prismatic member engaging in the channels. The protuberances disposed on the other two edges allow several modules to be coupled together side by side by insertion through the protuberances, which are provided with a cylindrical bore, of respective rods which allow for relative rotation of the modules, thereby allowing any surface or volumetric area of any shape to be formed and covered with modules.

BRIEF DESCRIPTION OF THE DRAWINGS

Further details and features of the present invention will be disclosed in the following description with reference to the accompanying drawings showing preferred details which are given as an example, relating to one possible embodiment, but the invention is not limited and, therefore this description should be considered only from an illustrative point of view, and, wherein:

FIG. 1 is a front elevation view of the module 10 of the invention having protuberances 10' on the side edges, there being disposed in the interior thereof cylindrical through bores 11, the protuberances 10' of one edge being staggered relative to those of the other;

FIG. 2 is a top plan view of a module 10 in which we can see an upper channel which allows one module (10) to be locked relative to another adjacent one, as well as on the sides by protuberances 10' which have a semicircular perimeter in some cases; and in others are rounded at the rear; having a sharp edge at the front.

FIG. 3 is a side elevation view of the module of FIG. 1;

FIG. 4 is a top plan view showing an example of how two modules 10 may be hingedly joined together at the side by a rod 11' placed in through-bores 11 and due also to the semicircular profile of the protuberances 10.

FIG. 5 is an enlarged cross-sectional view which shows how two modules 10 are vertically superimposed and are locked together vertically by way of channels 13 and a prismatic member inserted therein although they may move hingedly due to the rod 11';

FIG. 6 is an enlarged cross-sectional view showing how rod 11' is locked in place in the upper portion of module 10 by respective pins 15 locking the head 14 of rod 11' to the module 10, and how rod 11' penetrates in the adjacent module by conventional screw threading;

FIG. 7 is an elevational view showing an application of the invention wherein several modules 10 are placed hinged together by rods 11' on a beach 12 and due to their possible articulation may adapt themselves to the configuration of the beach 12;

FIG. 8 an application of the invention in a retaining wall, as may be seen in FIG. 9, formed by a plurality of modules (10) connected together side by side and also one above the other with respective possible perforation points 19;

FIG. 9 is a cross-sectional view showing a retaining wall formed by a plurality of modules 10 connected together as shown in FIG. 8 and braced by respective wedges connected to respective cables or tension members 17, for containing the earth 16; and FIG. 10 is a plan view showing another application of the module of the invention wherein a plurality of modules in the form of a ring or polyhedral figure such as a tank, the slabs being attached or braced together by respective tension members 17.

DETAILED DESCRIPTION

The improved module of the present invention in one of the preferred embodiments thereof as may be seen in FIGS. 1, 2 and 3, is formed by a generally prismatic slab 10 having a channel 13 in the upper edge and a channel 12' in the lower edge, in which a prismatic member is inserted when it is desired to place one above the other.

Protuberances having a rectangular profile 10' extend from the lateral sides or lateral edges and have therethrough respective through-bores 11 of cylindrical shape, the protuberances 10' of one edge being staggered relative to those of the other edge.

Several modules 10 are coupled together side by side by lining up two modules 10 so that by way of a rod 11' inserted in the bores 11 the parts 10 are duly held together in such a way as may be seen in FIG. 4 that relative rotation thereof is possible due to the semicircular profile of the protuberances 10' with which, as may be seen in FIG. 7, it is possible to form footpaths or passageways on any type of terrain, for example a beach, with adaptation to the shape of the terrain due to the relative rotation between adjacent slabs 10 connected by rod 11' through aligned bores 11.

Several slabs 10 forming a retaining wall as may be seen in FIGS. 8 and 9 may be assembled together by mounting several slabs 10 side by side and one above the other by way of rods 11' and by way of the channels 13. To this end, the rods 11' may have a threaded internal bore 20 in one end portion thereof and an external screw thread on the other end portion thereof for threadedly engaging in an internally threaded bore in an adjacent rod for coupling the rods together to retain the assembled slabs together. Of course the screw threaded connection can be varied to accommodate use of the rods on assemblies of different numbers of slabs, such as shown in FIGS. 5, 8 and 9. The set of rods 11' is locked in place by way of the head 14 on at least one of the rods firmly retained by studs 15 connected to the top or edge of a slab 10 by screw threads 30, for example, as may be seen in FIG. 6. The head 14 is provided with bores 14', the purpose of which is receive studs 15 therethrough and to serve as bearing points for a spanner wrench (not shown) which, having two small bosses to be inserted in the bores 14', can be used to rotate 11' to be in the bores 11.

The retaining walls which it is desired to build using the modules 10 may be adapted to any shape in view of the possibility of relative rotation between adjacent slabs. It is not necessary for all slabs 10 to be contained in a single vertical or horizontal plane, but the shape of the connected group may be fully curved with several changes of curvature as required to contain the earth, for example. To facilitate the installation following a curved line, the protuberances 10' at the rear of the perimeter thereof are rounded and have a sharp edge at the front thereof, whereby the operation of sealing the slabs 10 is facilitated.

In a further embodiment as may be seen in FIG. 10 for the formation of a tank for water or the like, there is disposed a set of modules 10 duly held at the sides by the rods 11' and braced together by the tension members 17, all of which allows the speedy formation of any container without the need for shuttering or work of any type.

To facilitate the bracing of the slabs 10 by the tension members 17 one of the protuberances 10 is of a smaller height h' than others h, which allows fitting of washers (not shown) on the rod 11' to fasten the tension members. In a similar, way on the front surface of the slab there are points or areas 19 where slabs may be perforated without interfering with the reinforcement of the slabs 10.

It will be understood after seeing the drawings and the explanation given thereof that the of the present application provides a simple effective construction which may be reduced to practice with great ease, forming without any doubt a new industrial result.

It is noted, that variations and detail changes may be made in the invention without modifying the scope thereof as set forth in the following CLAIMS.

I claim:

1. Construction module comprising:

a slab having a substantially prismatic shape with at least two pairs of opposite edges each having a direction of extension;

a plurality of spaced protuberances extending outwardly from the opposite edges of one pair of said at least two pairs of opposite edges so that spaces are provided between said protuberances on a common edge;

aligned holes in said protuberances on a common edge;

said protuberances on one edge of said one pair of opposite edges being staggered relative to said protuberances on the opposite edge of said one pair of opposite edges so that a plurality of modules when assembled together have said protuberances on said one edge of a module interfitting in said spaces between said protuberances on said opposite edge of an adjacent module with said holes aligned;

longitudinal channels in the opposite edges of a second pair of said at least two pairs of opposite edges of said slab extending substantially parallel with said opposite edges of said second pair of opposite edges;

distal ends on said protuberances having a substantially semicylindrical shape with a substantially semicircular cross section; and at least one of said protuberances on each opposite edge of said one pair of opposite edges having a width in the direction of extension of said each opposite edge of said one pair of opposite edges less than the width of other protuberances on the same edge.

2. A modular construction comprising:

a plurality of identical modules, each module comprising a slab having a substantially prismatic shape with at least two pairs of opposite edges each having a direction of extension, a plurality of spaced protuberances extending outwardly from the opposite edges of one pair of said at least two pairs of opposite edges so that spaces are provided between said protuberances on a common edge, aligned holes in said protuberances on a common edge, said protuberances on one edge of said one pair of opposite edges being staggered relative to said protuberances on the opposite edge of said one pair of opposite edges so that a plurality of modules when assembled together have said protuberances on said one edge of a module interfitting in said spaces between said protuberances on said opposite edge of an adjacent module with said holes aligned, longitudinal channels in the opposite edges of a second pair of said at least two pairs of opposite edges of said slab extending substantially parallel with said opposite edges of said second pair of opposite edges;

distal ends on said protuberances having a substantially semicylindrical shape with a substantially semicircular cross section, and at least one of said protuberances on each opposite edge of said one pair of opposite edges having a width in the direction of extension of said each opposite edge of said one pair of opposite edges less than the width of other protuberances on the same edge;

elongated rods extending through said aligned holes in said protuberances of adjacent slabs having interfitted protuberances and spaces;

connecting means on the ends of said rods for connecting said rods together end to end; and cooperating means on one end of at least some of said rods and on at least some of said slabs for rigidly attaching said at least some rods to said at least some slabs.

3. A modular construction as claimed in claim 2 wherein:

said connection means comprises screw threaded connections.

4. A modular construction as claimed in claim 3 wherein said cooperating means comprises:

a flanged head on one end of said at least some rods;

a plurality of flange holes through each flanged head;

a plurality of screw threaded bores in an edge of a protuberance at an edge of said at least some slabs adjacent said hole in each protuberance; and a plurality of screw threaded studs extending through said flange holes and engaging said bores.

5. A modular construction as claimed in claim 2 and further comprising:

means insertable into opposing channels in adjacent edges of said second pair of said at least two pairs of opposite edges of adjacent slabs for maintaining said adjacent edges aligned longitudinally.

6. A modular construction as claimed in claim 4 and further comprising:

means insertable into opposing channels in adjacent edges of said second pair of said at least two pairs of opposite edges of adjacent slabs for maintaining said adjacent edges aligned longitudinally.

7. A modular construction as claimed in claim 2 and further comprising:

washer means on said rods in said spaces between adjacent protuberances of different widths on connected adjacent slabs.

8. A modular construction as claimed in claim 6 and further comprising:

washer means on said rods in said spaces between adjacent protuberances of different widths on connected adjacent slabs.

* * * * *